United States Patent [19]

Webster

[11] 4,130,930

[45] Dec. 26, 1978

[54] LOCATING LOCK CASES IN DOORS

[76] Inventor: Desmond E. C. Webster, 1 Sweetmount Park, Dublin 14, Ireland

[21] Appl. No.: 820,103

[22] Filed: Jul. 29, 1977

[30] Foreign Application Priority Data

Aug. 9, 1976 [GB] United Kingdom ..... 33151/76

[51] Int. Cl.[2] ..... E05C 1/08; E06B 1/00

[52] U.S. Cl. ..... 29/466; 292/337; 144/3 R

[58] Field of Search ..... 408/72 R, 103, 108, 408/117; 29/466, 467, 464; 144/92, 27, 314 R, 3 R; 292/337

[56] References Cited

U.S. PATENT DOCUMENTS

| | | | |
|---|---|---|---|
| 2,790,470 | 4/1957 | Graham | 144/3 R |
| 3,055,691 | 9/1962 | Kessel | 292/337 |
| 3,190,683 | 6/1965 | Schlage | 292/337 |
| 3,500,884 | 3/1970 | Hand et al. | 144/3 R |

*Primary Examiner*—Milton S. Mehr
*Attorney, Agent, or Firm*—Fred Wiviott

[57] ABSTRACT

Latch sets must be fitted with a flat face of the latch bolt parallel to a major door face such that the bolt is correctly received in the door frame bolt recess. Latch sets comprise the handles, actuating mechanism, and latch bolt case including the bolt. Here, the latch bolt case is adapted for correct alignment of the latch bolt flat face when the latch bolt case is positioned in a latch bolt case passageway. The latch bolt case is provided with a self-retaining non-cylindrical end portion to avoid the need for recessing the door edge for a latch bolt case plate. Instead, a jig is provided for guiding the case into a retained position within the passageway in which it is a progressive force fit.

11 Claims, 9 Drawing Figures

FIG. 1
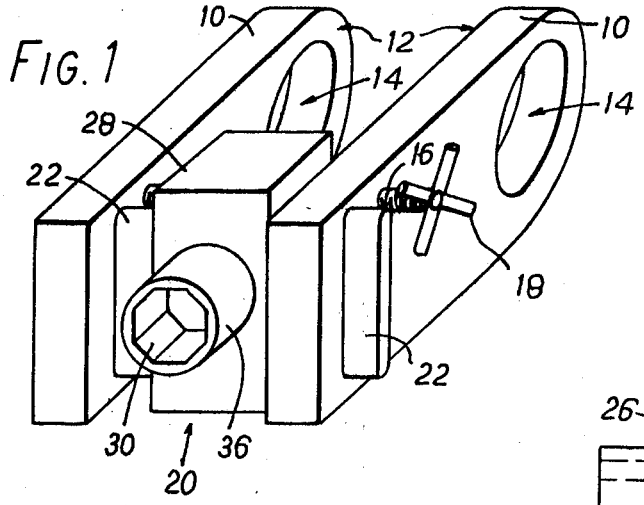
FIG. 2
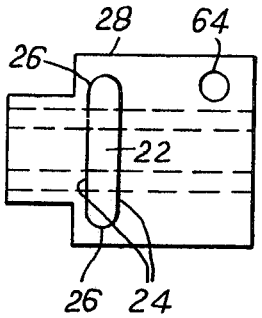
FIG. 3
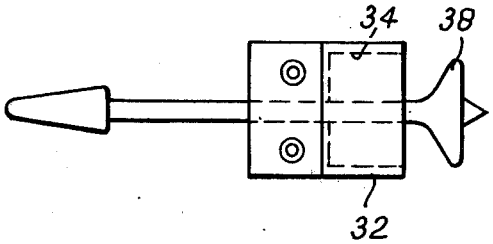
FIG. 4
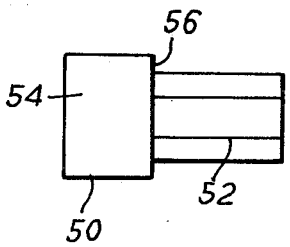
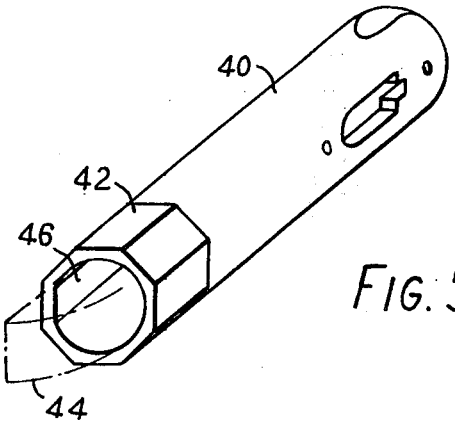
FIG. 5

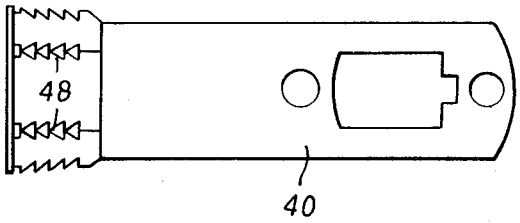
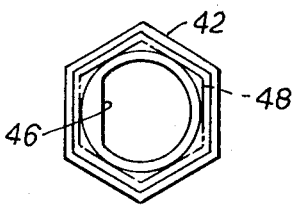
FIG. 6
FIG. 7
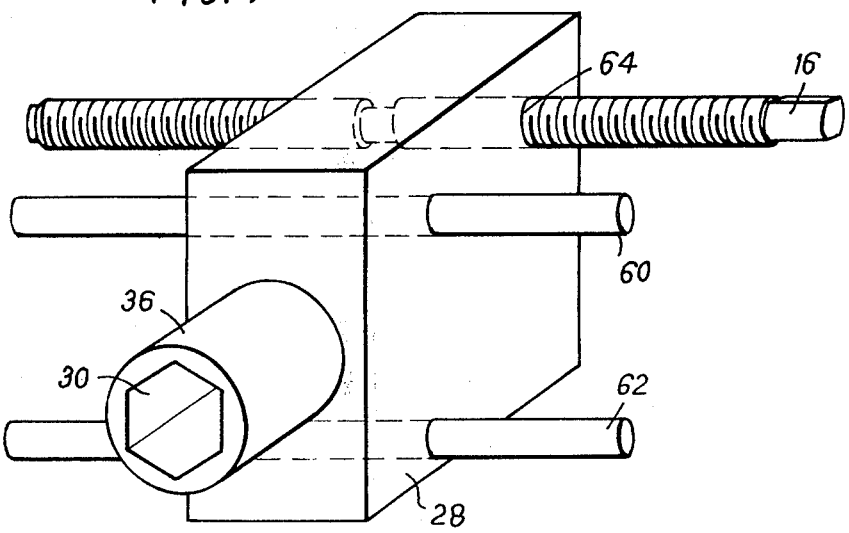

LOCATING LOCK CASES IN DOORS

BACKGROUND OF THE INVENTION

Lock sets and latch sets for securing doors in their closed position are installed in the fabric of the door itself. It is a requirement that the latch bolt extends through the edge of the door to be received in an aligned recess in a door frame. The door handles extend perpendicularly to the latch bolt so as to manipulate a coupling mechanism to release the latch bolt from the recess in the door frame when it is required to open the door. The lock set version has a locking mechanism for locking the latch bolt when the door is closed. For internal doors the locking mechanism is not required and thus a latch set and not a lock set is provided. The door itself is therefore required to have a passageway through the major surfaces of the door extending normally to the passageway leading to the door edge for the latch bolt. In the past the passageway for the latch bolt and the passageway for the latch set handles have been drilled. The latch bolt passageway is drilled by drilling a hole into the edge of the door and the latch set handle passageway is produced by drilling a hole normally to the first passageway through a side surface of the door. In addition it is well known that the latch bolt has a case which at its outer end has a plate to be located in a recess at the door edge. Usually this recess is formed after the latch bolt passageway has been drilled. The recess to receive the latch bolt case plate ensures that the latch bolt case is properly located in the door frame such that a flat face on the latch bolt is correctly aligned with the major plane of the door, that is the plane of its side faces. In addition the latch bolt case plate is provided with means for securing the locks case in the door itself.

This construction has the disadvantage that the formation of the plate receiving recess which is accomplished by a carpenter on site, usually involves labor time in the order of 30 to 45 minutes. This is expensive labor time as there are usually a number of latch sets or lock sets to be fitted in each house on a building development. Typically, there will be at least seven latch sets per house. The formation of the recess is usually by means of hammer and chisel since the recess is formed by the removal of the relevant portion of the door which is completely bounded. It is therefore not possible to remove the wood by sawing.

Accordingly, the present invention has an object, the provision of a latch bolt case which does not require a plate to be inserted in a door edge recess, but which is readily aligned such that the flat face of the latch bolt is parallel to the major face of the door.

It is a further object of the invention to provide a latch bolt case which is readily and speedily fitted in a latch bolt case passageway which has simply to be drilled.

It is a further object of the invention to provide a latch case which is provided with self-retaining means when inserted in a latch bolt case passageway.

It is a further object of the present invention to provide a drilling jig assembly which enables the passageways for the latch bolt and the latch set handles to be speedily formed with the correct alignment and which then enables the latch bolt case to be speedily positioned with the correct alignment.

It is a further object of the invention to provide an improved method of installing a lock case in a door which avoids the lengthy use of carpenters time subsequent to the formation of the drilled passageways in the door.

SUMMARY OF THE INVENTION

According to the present invention there is provided a latch bolt case for a latch set or lock set comprising a casing housing a latch bolt in which the latch bolt with a conventional flat face is biased into a door locking position and the casing is adapted for receiving the connecting parts of the sets whereby the latch bolt may be manipulated, characterized in that the casing has an end portion of non-circular cross-section and the flat face of the latch bolt is orientated in relation to the cross-section of the end portion so as to enable the flat face to be aligned with the major face of a door when the latch bolt case is inserted in a latch bolt passage of a door. Preferably said end portion is adapted to progressively become a force fit in the door when inserted in a passageway in which a remaining portion of the latch bolt case is a sliding fit.

The inventor considered simply enlarging the end of the latch bolt case with a cylindrical end portion of circular cross-section. This was found to have two disadvantages. Firstly, the orientation of the latch bolt case was critical to the correct alignment of the latch bolt flat face with the door major face and thus the latch bolt receiving recess in the frame. With an enlarged cylindrical end portion, there is no reference point nor guide surface to align with a similar door face. In consequence, it is believed that the use of the case with a cylindrical end portion would result in practice with the latch bolt being incorrectly aligned. In contrast the use of the latch bolt case with the non-cylindrical end portion guarantees correct alignment of the latch bolt flat face is such a non-cylindrical end portion is guided in a suitable jig as is hereinafter defined. Secondly, the latch bolt case with the enlarged cylindrical end has a sharp discontinuity between the enlarged end portion and the remaining portion which discontinuity defines a step which if the latch bolt case is hammered into position tends to split the door. By providing an end portion adapted progressively to become a force fit in the door, the wood is not damaged.

It is therefore a preferred feature that the end portion is tapered to become progressively a force fit in the door when inserted in the latch bolt case passageway and that this end portion is adapted to resist removal from the passageway. For the latter purpose the non-cylindrical end portion is provided with barbs extending longitudinally of the latch bolt case. One preferred non-circular cross-section is hexagonal and the barbs extend along each corner of the hexagonal form. Other cross-sections include other polygonal shapes, but the shape need not be a regular geometrical shape and, for example, a flat face on a circular section would meet the functional requirement of aligning the bolt by orientation of the case with respect to the flat face of the case.

In order to employ this latch bolt case most effectively, it is of considerable assistance to have means to guide the latch bolt case into the door.

Accordingly, another aspect of the invention provides a drilling jig assembly comprising a pair of arms for engaging opposite sides of a door including aligning openings through which a cross-hole can be formed in a door, means for drawing the arms towards one another for clamping a door between them, a drilling jig extending between the arms and having a tubular guide through which a drill bit can pass for drilling a latch bolt case passageway in the door to intersect the cross-hole, the tubular guide having a non-circular guide hole for guiding a latch bolt case having an end portion with a non-circular cross-section in order that a flat surface of the latch bolt may be aligned with the major surface of the door.

The drilling jig may have at least one element slidably received in a complementary opening in one of the arms to permit the arms to move towards and away from one another, the element and opening being non-circular to prevent pivoting of the jig on the element.

The tubular guide may have a cylindrical outer surface for fitting within a cylindrical socket of a drill bit guide so that a drill bit can be guided axially through the tubular guide.

Once a latch bolt passageway has been drilled into a door, a latch bolt case can be directed into the passageway by the tubular guide. An enlarged end portion of the lock case with a cross-section corresponding generally to the shape of the guide hole in the tubular guide can be accurately directed by the guide to ensure that the axis of the latch bolt case is aligned with the axis of the hole. By making the passageway in the tubular guide and the enlarged portion of the latch bolt case non-circular, the guide can be correctly positioned to ensure that the flat of a latch bolt will be in a plane substantially parallel to the sides of the door when the latch bolt case is located in the door, and therefore aligned with the bolt receiving recess in the door frame.

Also according to the invention, there is provided the combination of a drilling jig assembly with a latch bolt case for receiving a latch bolt with a flat face on one side so that the latch bolt projects from an enlarged portion of the latch bolt case, the enlarged portion having a non-circular cross-section, the drilling jig comprising a pair of arms having flats for engaging opposite sides of a door, means for drawing the arms towards one another for clamping a door between them, a drilling jig extending between the arms and having a tubular guide for closely receiving the enlarged part of the latch bolt case for guiding the latch bolt case into a latch bolt case hole in the door while keeping the latch bolt case orientated so that the flat of the latch bolt will be in a plane substantially parallel to the sides of the door when located in the case.

A latch bolt case driver having a driving portion which is small enough to pass through the hole in the tubular guide can be used to drive the latch bolt case into place in the latch bolt case passageway. The driver can be of the same shape as the passageway but this is not essential.

The present invention also provides a method of installing a lock case in a door, which comprises forming a cross-hole through the door, forming a latch bolt case passageway in the door so that the latch bolt case passageway intersects the cross-hole and driving a latch bolt case having a non-circular enlarged portion into the latch bolt case passageway while using a jig to prevent rotation of the latch bolt case as it is driven into the door.

BRIEF DESCRIPTION OF DRAWINGS

Embodiments of the invention will now be described, by way of example only, with reference to the accompanying drawings, in which:

FIG. 1 is a three-dimensional representation of a drilling jig assembly;

FIG. 2 shows a drilling jig of the assembly;

FIG. 3 shows a drill bit and drill bit guide for use with the jig;

FIG. 4 shows a latch bolt case driver;

FIG. 5 shows a latch bolt case;

FIG. 6 shows side and end elevations of an alternative latch bolt case;

FIG. 7 shows an alternative drilling jig;

DETAILED DESCRIPTION OF EMBODIMENTS

Figure 8:
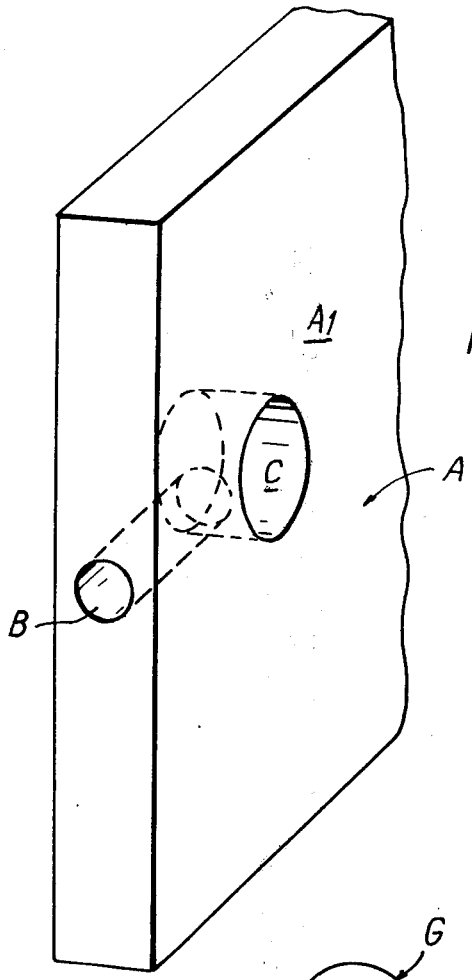
FIG. 8 shows a pre-drilled door.

In FIG. 1, a drilling jig assembly comprises a pair of arms 10 having flats 12 for engaging opposite sides of a door. The arms contain aligned openings 14 through which cross-hole can be formed in a door.

A threaded shaft 16 has a right hand threaded portion screwed into one of the arms 10 and a left hand threaded portion screwed into the other arm. A handwheel 18 is fixed on one end of the shaft and can be used to move the arms 10 towards and away from one another by rotating the shaft.

A drilling jig 20 is provided with a pair of locating elements 22 which are received in complementary openings in the arms 10. The elements 22 are non-circular, having parallel sides 24 with rounded ends 26, and this prevents the jig pivoting with respect to the arms. Alternatively, the elements 22 could be replaced by two round rods 60 and 62 (FIG. 7) to allow sliding movement of the arms 10 while still preventing pivoting of the drilling jig. The jig also has a central tubular guide portion 28 with a guide hole 30 of octagonal cross-section. The shaft 16 passes through a hole 64 in the guide portion 28 as shown in FIG. 2.

In FIG. 3 a drill bit guide 32 has a socket 34 for fitting onto a cylindrical spigot portion 36 of the tubular guide 28. A drill bit 38 is mounted within the guide 32 and can be guided axially through the hole 30 when the spigot 36 is received in the socket 34. Once the drilling jig assembly has been clamped onto a door and a cross-hole has been formed in the door in the region of the openings 14, the drill bit can pass through the tubular guide 28 and can drill a latch bolt case passageway into the door so that is intersects the cross-hole.

The latch bolt case shown in FIG. 5 has a cylindrical barrel 40 with an enlarged end portion 42 from which a latch bolt 44 will project when the latch bolt case is installed in a door. The barrel 40 has a flat surface 46 which will lie against a flat on the latch bolt 44. As the drawing clearly shows, the enlarged portion 42 is of octagonal cross-section and it is of such a size that will fit closely within the guide hole 30 in the tubular guide 28 (FIG. 1). Thus, once the barrel 40 has passed into a hole drilled in the door, the enlarged portion 42 and the guide 28 can co-operate to prevent turning of the lock case as it is driven into the hole. The outer faces of the enlarged end portion are tapered so as to progressively force fit into the passageway drilled by the bit 38 in which barrel 30 is a sliding fit.

The latch bolt case of FIG. 6 is of similar construction to that of FIG. 5 and similar reference numerals are used to refer to similar parts. In the latch bolt case of FIG. 6, the enlarge portion 42 is hexagonal instead of octagonal and is provided with herringbone-like detents or barbs 48 which permit the enlarged portion to be driven into a hole or passageway but serve to securely retain the latch bolt case in a door once it has been installed. When the case of FIG. 6 is to be installed in a door, the jig 20 is replaced by a jig having a guide hole 30 of suitable cross-section, such as that shown in FIG. 7. Again the enlarged portion 42 has a taper such that the latch bolt case progressively becomes a force fit when installed.

In FIG. 4 a latch bolt case driver 50 is provided for driving the latch bolt case through the guide hole 30 and into the door. The driver has a driving portion 52 which is of the same cross-section as the hole 30 but which is slightly smaller than the hole. However, it is not necessary for the shape of the driver to be the same as the shape of the hole. The driver also has a head 54 with an abutment shoulder 56.

For installing a latch bolt case in a door, the assembly of FIG. 1 is clamped onto the door at the height at which the latch bolt case is to be fitted. This is effected by turning the handwheel 18 to draw the arms 10 towards one another and to clamp the door between the flats 12. The assembly is located so that the distance between the edge of the door and the free end of the spigot 36 is equal to the length of the driving end portion 52 of the driver 50. At this stage, one end of the guide portion 28 abutts against the door.

A cross-hole is drilled across the door through the openings 14. A latch bolt case passageway is then drilled into the door by the drill bit 38 which passes through the guide hole 30 and is guided by the combination of the guide 28 with the guide 32 (FIG. 3). The hole or passageway is drilled until it intersects the cross-hole through the door. The drill bit 38 and guide 32 are then removed. The diameter of the latch bolt case hole is approximately equal to the diameter of the narrower end of the latch bolt case.

With the assembly still clamped to the door, the latch bolt case is inserted into the latch bolt case passageway through the guide hole 30 until the enlarged non-circular portion 42 reaches the guide hole 30. The enlarged portion is then driven through the guide hole and into the door using the driver 50 with the flat surface 46 substantially parallel to the sides of the door. The shoulder 56 of the driver will abut against the free end of the spigot 36 when the latch bolt case has been driven to the correct depth into the door. The assembly can then be removed from the door. Because the enlarged portion 42 is larger than the diameter of the latch bolt case hole, the latch bolt case driven into the door will bite into the wood of the door and will remain in place without the need for screws or other fasteners. The teeth or barbs 48 greatly assist the retention of the latch bolt case in the door.

Because the enlarged portion 42 is of a non-circular cross-section and the guide hole 30 is of a similar shape, the guide hole 30 can ensure that the flat surface 46 remains parallel to the sides of the door when the enlarged portion 42 of the lock case is being driven into the door. This means that the flat of the latch bolt will be parallel to the sides of the door when the latch bolt is installed.

The form of barbs or teeth 48 may be modified whilst retaining the general function of retaining the latch bolt case in the door.

The door A shown in FIG. 8 is factory made and pre-drilled with the latch bolt case passageway B and cross-section hole C. It is intended that the latch bolt case F of FIG. 9 (generally similar to that of FIG. 6) will be fitted on site by employing a T-shaped jig member D. The T-shaped jig member D has a first part E for holding the latch bolt face J of latch bolt I in the latch bolt case F parallel to the major face A1 of the door A and a second part D1 abutting the major face of door A.

As is known, a latch set has a latch set actuating mechanism namely, connecting parts of the latch set (now shown) which extend through the cross-hole C of the door A and an aperture H in the latch bolt case F. The aperture H is provided in all such latch bolt cases F and it is merely necessary to dimension jig member part E to be a sliding fit in standard sized apertures H.

In order to correctly orientate the latch bolt face J, the end G of the latch bolt case F is slid into the latch bolt case passageway B and then the latch bolt case F is orientated, by rotation if necessary, such that the aperture H for the latch set connecting parts (not shown) is aligned with the cross-hole C. Then the first part E of the T-shaped jig member D is inserted into cross-hole C and through aperture H until the second part D1 of the jig member abuts the major face A1 of the door A. There after the latch bolt case F is driven, for example by means of a driver 50 (FIG. 4) into the passageway B until fully inserted and retained therein by its barbs 48 on its non-cylindrical end 42 (FIG. 6). During this driving operation the second part D1 of the jig member D is maintained in abutment with the door major face A1. Next, the first part E of the jig member D is removed from aperture H and cross-hole C. The relative dimensions of jig member first part E and cross-hole C are such as to permit clearance between first part E and the wall of the cross-hole C prior to and subsequent to said driving of the latch bolt case F.

Figure 9:
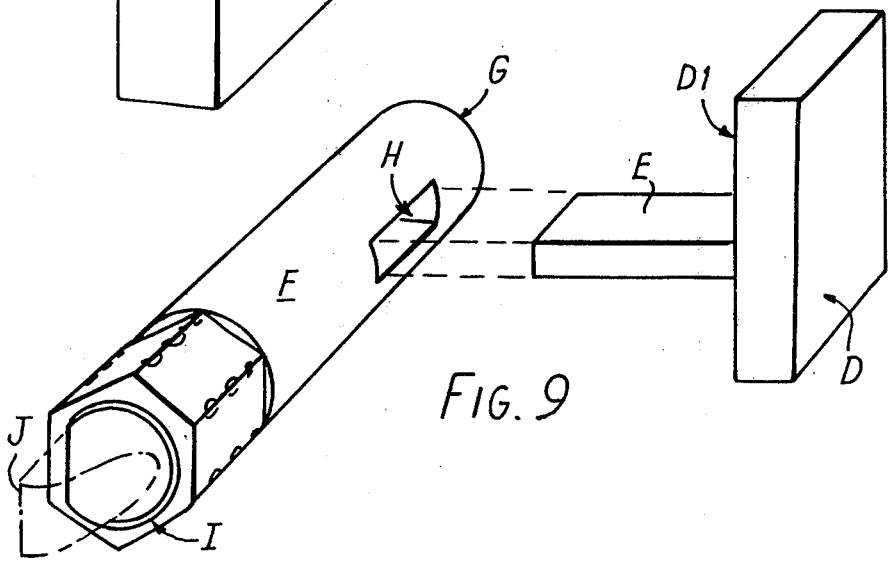
FIG. 9 shows a latch bolt case and a T-shaped jig member for fitting the case into the door of FIG. 8.

The jig member D may be used with latch bolt cases not provided with a non-cylindrical portion as in FIGS. 5, 6 and 9 but these latch bolt cases are the preferred form. Jig member D is described as a T-shaped jig member. Functionally the first part E must be adpated for insertion in aperture in aperture H and a face of part D1 must be adapted to abut door major face A1. Consequently, the body of part D may be shaped differently to that shown and for example, may be provided with a hand-grip (not shown).

I claim:

1. A latch bolt case for a latch set or lock set comprising a casing housing, a latch bolt in which the latch bolt with a conventional flat face is biased into a door locking position and the casing is adapted for receiving the connecting parts of the sets whereby the latch bolt may be manipulated, characterized in that the casing has an integral end portion of non-circular cross-section including at least one planar alignment face and the flat face of the latch bolt is orientated in relation to the planar alignment face of the end portion so as to enable the flat face to be aligned with the major face of a door when the latch bolt case is inserted in a latch bolt passage of a door.

2. A latch bolt case as claimed in claim 1, wherein said end portion is adapted to progressively become a force fit in the door when inserted in a latch bolt passageway in which a remaining portion of the latch bolt case is a sliding fit.

3. A latch bolt case as claimed in claim 1, wherein the end portion is tapered to become progressively a force fit in the door when inserted in the latch bolt case passageway and that this end portion is adapted to resist removal from the passageway.

4. A latch bolt case as claimed in claim 3, wherein the non-cylindrical end portion is provided with barbs extending longitudinally of the latch bolt case.

5. A latch bolt case as claimed in claim 3, wherein the non-circular cross-section is hexagonal and barbs extend along each corner of the hexagonal form.

6. A drilling jig assembly comprising a pair of arms for engaging opposite sides of a door, an aligned opening in each arm through which a cross-hole can be formed in a door, means for drawing the arms towards one another for clamping a door between them, a drilling jig extending between the arms and having a tubular guide through which a drill bit can pass for drilling a latch bolt case passageway in the door to intersect the cross-hole, the tubular guide having a non-circular guide hole for guiding a latch bolt case having an end portion with a mating non-circular cross-section in order that a flat surface of the latch bolt may be aligned parallel with the major surface of the door.

7. A drilling jig as claimed in claim 6, comprising at least one element slidably received in a complementary opening in one of the arms to permit the arms to move towards and away from one another, the element and opening being non-circular to prevent pivoting of the jig on the element.

8. A drilling jig as claimed in claim 6, wherein the tubular guide has a cylindrical outer surface for fitting within a cylindrical socket of a drill bit guide so that a drill bit can be guided axially through the tubular guide.

9. A method of installing a latch bolt case having a first non-circular alignment portion in a door having a cross-hole and a latch bolt casing passageway intersecting the cross-hole, employing a jig having a second non-circular alignment portion complimentary to the first alignment portion and a third generally alignement portion, the steps of positioning said jig with said third alignment portion in engagement with a major surface of the door and engaging said first alignment portion with the second alignment portion, driving said latch bolt case in an end-wise relation into said latch bolt passageway while maintaining the first and second alignment portions in engagement to prevent rotation of the latch bolt case as it is driven into the door.

10. A method as claimed in claim 9, wherein the latch bolt case being fitted on site, employing a T-shaped jig member comprising a first part having said second alignment portion for holding the latch bolt case with the flat face parallel to the door major face and a second part having said third alignment portion to abut one major face of the door, the method further comprising sliding the latch bolt case into the latch bolt case passageway, orientating the latch bolt case such that the aperture therein for receiving the connecting parts of the latch set includes said first alignment portion and is aligned with the cross-hole, inserting the first part of the jig member through said aperture and arranging for the second part of the jig member to abut the door, and driving the latch bolt case into the passageway whilst maintaining the second part in abutment with the door major face, then removing the jig, the first part of which extends through the latch bolt case aperture leaving clearance of the wall of the cross-hole prior to and subsequent to said driving of the latch bolt case.

11. A method as claimed in claim 9, wherein the second alignment portion of the jig includes a latch bolt case guide hole having a similar non-circular cross-section to the latch bolt case, the method comprising the step of orientating the latch bolt case with respect to said guide hole prior to driving the latch bolt case with a driver adapted to be driven along said guide hole.

* * * * *

UNITED STATES PATENT OFFICE

CERTIFICATE OF CORRECTION

Patent No. 4,130,930 Dated December 26, 1978

Inventor(s) Desmond E. C. Webster

It is certified that error appears in the above-identified patent and that said Letters Patent are hereby corrected as shown below:

Column 7, Claim 9, line 32, after "generally" insert --planar--;
same line, cancel "alignement" and substitute --alignment--.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*